United States Patent [19]

O'Donnell

[11] Patent Number: 4,662,550

[45] Date of Patent: May 5, 1987

[54] CHARACTER PACK

[75] Inventor: Roseann O'Donnell, Brooklyn, N.Y.

[73] Assignee: Dover Handbag Co., Inc., New York, N.Y.

[21] Appl. No.: 800,878

[22] Filed: Nov. 22, 1985

Related U.S. Application Data

[63] Continuation-in-part of Ser. No. 742,670, Jun. 7, 1985, abandoned.

[51] Int. Cl.[4] ..... A45F 3/04

[52] U.S. Cl. ..... 224/209; 224/153; 224/259; 446/26

[58] Field of Search ..... 224/209, 153, 259; 446/26, 27, 28

[56] References Cited

U.S. PATENT DOCUMENTS

| | | | |
|---|---|---|---|
| D. 260,697 | 9/1981 | Fitzgerald et al. | D3/32 |
| D. 260,698 | 9/1981 | Fitzgerald et al. | D3/32 |
| D. 267,051 | 11/1982 | Tucker | D3/44 |
| D. 269,826 | 7/1983 | Ko | D3/44 |
| 1,959,331 | 5/1934 | Bour | 224/153 |
| 4,068,314 | 1/1978 | Yellen et al. | 224/209 |
| 4,174,059 | 11/1979 | Maunder | 224/209 |
| 4,334,643 | 7/1982 | Farmer | 224/153 |
| 4,423,834 | 1/1984 | Rush | 224/151 |

OTHER PUBLICATIONS

"Back Magic 2", *The North Face*, Berkeley, California, 1983–1984 Fall, Winter Catalogue, p. 43.

*Primary Examiner*—Stephen Marcus
*Assistant Examiner*—David Voorhees
*Attorney, Agent, or Firm*—Blum Kaplan

[57] ABSTRACT

A character pack including a stuffed character having a hollow body portion and an integrally formed character's back pack on an exposed surface thereof is provided. The character's back pack is formed with a closable opening for providing access to the storage space within the character's back pack extending into the body volume for providing increased storage capacity.

10 Claims, 5 Drawing Figures

CHARACTER PACK

CROSS-REFERENCE TO RELATED APPLICATIONS

This is a continuation-in-part of co-pending U.S. Pat. application Ser. No. 742,670 filed June 7, 1985, now abandoned.

BACKGROUND OF THE INVENTION

This invention relates to a carrying case generally and more particularly to a stuffed character pack wherein the back of the stuffed character is formed with a character's back pack with a carrying space which extends into the interior of the stuffed character.

Many types of back packs and other containers worn over an individual's shoulders are available. Most back packs are configured in a conventional form of a canvas tote utilized for camping. Other types include novelty types, as shown in U.S. Pat. No. 4,174,059 wherein the back pack is in the shape of a four-limbed character namely, a frog. A storage space is formed within the character. In the embodiment illustrated, a zipper is provided in the region of a frog's mouth providing access to the interior space. The limbs of the character button together to form the straps of the back pack.

These conventional back packs, including the frog back pack are satisfactory and are particularly attractive to young children. However, the actual carrying space for large items, such as school books within the back pack is limited by the size of the body portion of the character. In order to increase the size of this carrying space the size of the character must be increased.

Accordingly, it is desirable to provide an improved carrying case in the shape of a character providing more space to carry items without unduly increasing the size of the character.

SUMMARY OF THE INVENTION

Generally speaking, in accordance with the invention, an improved character pack is provided. The character pack is formed in the shape of a stuffed character or figure, such as an animal or doll, with a character's back pack integrally formed in the back of the stuffed character. The space within the character's back pack extends into the interior of the stuffed character for providing an enlarged storage cavity within the character pack. Optionally, adjustable straps may be provided between the arm and leg on each side of the character so that the character pack may be worn over the shoulders of a wearer.

Accordingly, it is an object of the invention to provide an improved back pack.

It is another object of the invention to provide an improved back pack in the shape of a stuffed character.

It is a further object of the invention to provide an improved character pack wherein a stuffed character shape is formed with a character's back pack with the storage space of the character's back pack extending into the interior of the stuffed character.

Yet another object of the invention is to provide an improved character pack wherein adjustable straps extend between each arm and leg so that the character pack fits over the shoulders of a wearer.

Still other objects and advantages of the invention will in part be obvious and will in part be apparent from the specification.

The invention accordingly comprises an article of manufacture possessings the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawing(s), in which.

DESCRIPTION OF THE PREFERRED EMBODIMENTS

Figure 1:
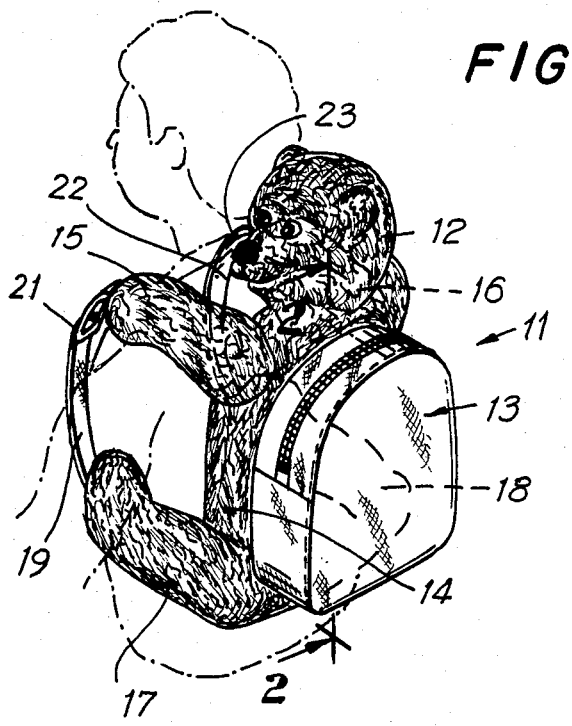
FIG. 1 is a perspective view of a pack in the shape of an animal constructed and arranged in accordance with the invention shown on the shoulders of a wearer.

Referring to FIG. 1, a perspective view of an character pack including a stuffed character with an integrally formed character's back pack on the back of the character is shown generally as 11. Character pack 11 is shown on the shoulders of a wearer. Character pack 11 includes a stuffed animal portion 12 having on its back an animal's back pack 13. Stuffed animal 12 is shown in the shape of a panda, it being understood that the invention is not limited to the shape of a panda and may be of any character shape, preferably one having four limbs.

Animal 12 has a body portion 14, a left arm 15, a right arm 16, a left leg 17 and a right leg 18. Left arm 15 and left leg 17 are joined at the ends of a strap 19 having an adjustable buckle 21. Similarly right arm 16 and right leg 18 are coupled by a strap 22 also having an adjustable buckle 23. Adjustable buckles 21 and 23 permit varying the length of straps 19 and 22 so that character pack 11 may be worn by wearers of different sizes.

In the construction illustrated in FIG. 1, animal back pack 13 is integrally formed on the back of body portion 14. A zipper 24 is provided across the top of animal back pack 13 for providing access into a storage portion 26 therein. As shown in cross-section in FIG. 2, an interior wall 27 defines an interior storage space 28 within the interior of body portion 14 of stuffed animal 12. Storage portion 26 of animal back pack 13 extends directly into interior storage 28 of body portion 14. Provision of storage portion 26 of animal back pack 13 integral with interior storage space 28 within stuffed animal 12 as a continuous carrying space results in substantially increased carrying capacity for character pack 11 without unnecessarily increasing the overall size of stuffed animal 12.

Figure 2:
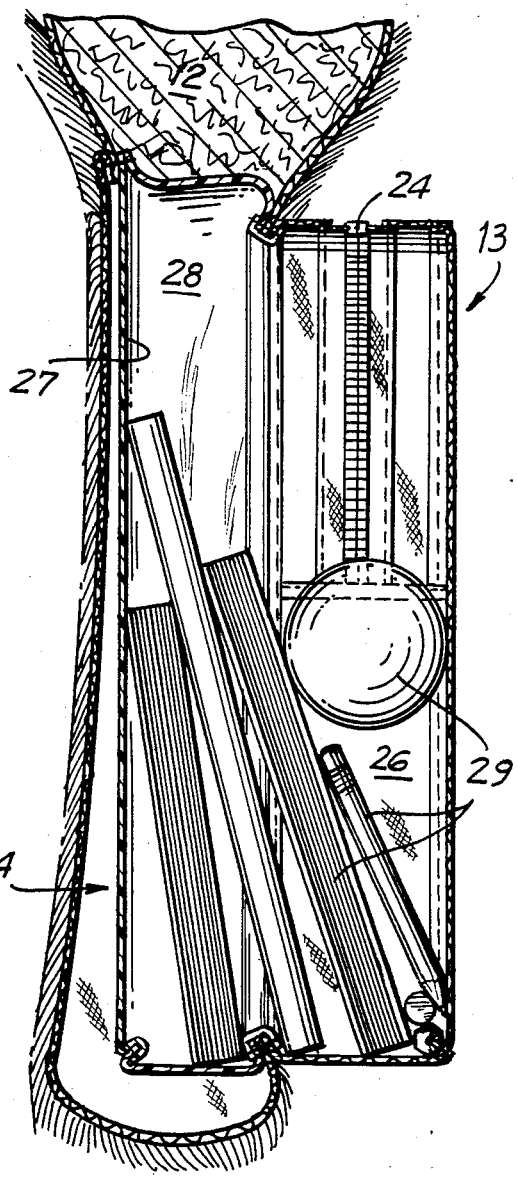
FIG. 2 is a cross-sectional view of the back pack portion of the animal pack taken through line 2—2 of FIG. 1.

Access to storage portion 26 and interior storage space 28 is obtained by opening zipper 24. This enlarged carrying space provides sufficient room for storage within character pack 11. For example, a wearer's schoolbooks and accessories 29 as shown in FIG. 2. may easily be stored within the carrying space in animal pack 11. Adjustable straps 19 and 22 enable animal pack 11 to be worn conveniently by small children as well as older children.

Stuffed animal 12 may be formed of a wide variety of material of construction and the invention is not limited to the embodiment shown or described. Animal pack 11 is formed of materials generally utilized for making stuffed characters and conventional back packs. The exterior of animal 12 is formed of a fabric, such as a brushed acrylic material, or the like. Interior wall 27 is formed from a waterproof vinyl or similar material so that if anything carried within storage portion 26 and interior storage space 28 is liquid and leaks the fabric and stuffing of animal 12 will be suitably protected. The body portion of the character other than the interior storage space is stuffed with a soft packing material. Similarly, the side edges and pack portion of animal back pack 13 are formed of a canvas, nylon or similar type material suitable for forming a carrying tote or conventional back pack.

Figure 3:
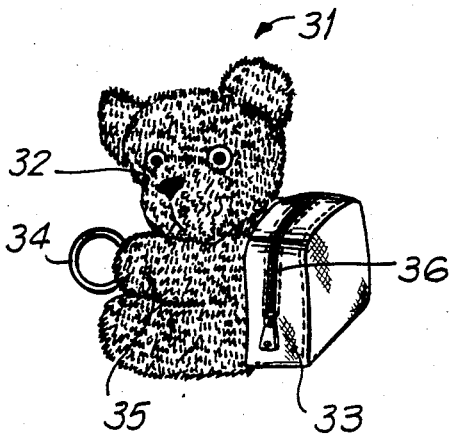
FIG. 3 is a perspective view of an animal pack in accordance with the invention suitable for use as a key case.

In FIG. 3, a pack 31 of a smaller size stuffed portion 32 than pack 11 is shown. A back pack 33 is formed on the back of body portion 32. Pack 31 is in the shape of a teddy bear with a key ring 34 held in one hand 35 of 32. Back pack 33 is formed with a zipper 36 for providing access into a storage portion which extends into the interior of body portion 32 in the same manner described in connection with pack 11 of FIGS. 1 and 2. Straps are not provided in this embodiment wherein pack 31 is particularly well suited for use as a key case, change purse or novelty case.

Figure 4:
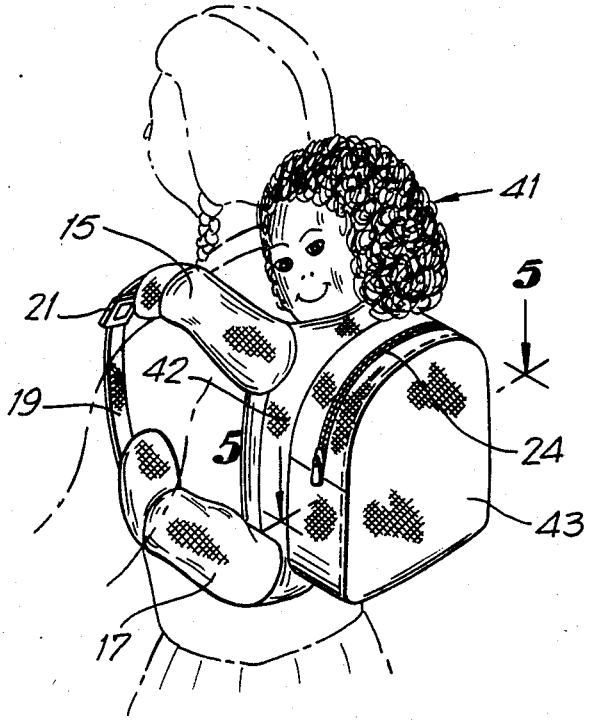
FIG. 4 is a perspective view of another embodiment of a pack constructed and arranged in accordance with the invention shown on the shoulders of a wearer.

FIG. 4 shows a further embodiment of a character back pack in accordance with the present invention. The character of FIG. 4 is a doll shown generally as 40. The invention is not intended to be limited to the animal and doll as illustrated herein. The character back pack of the invention can be an animal, a doll, a robot, or other such figure or character. Generally, the shape of the character or figure would be one which is attractive to young children.

Doll pack 41 includes a doll body portion 42 and a doll back pack 43 which extends into doll body portion 42 in the same manner as animal pack 11 of FIGS. 1 and 2 All similar elements have been given corresponding reference numerals.

Figure 5:
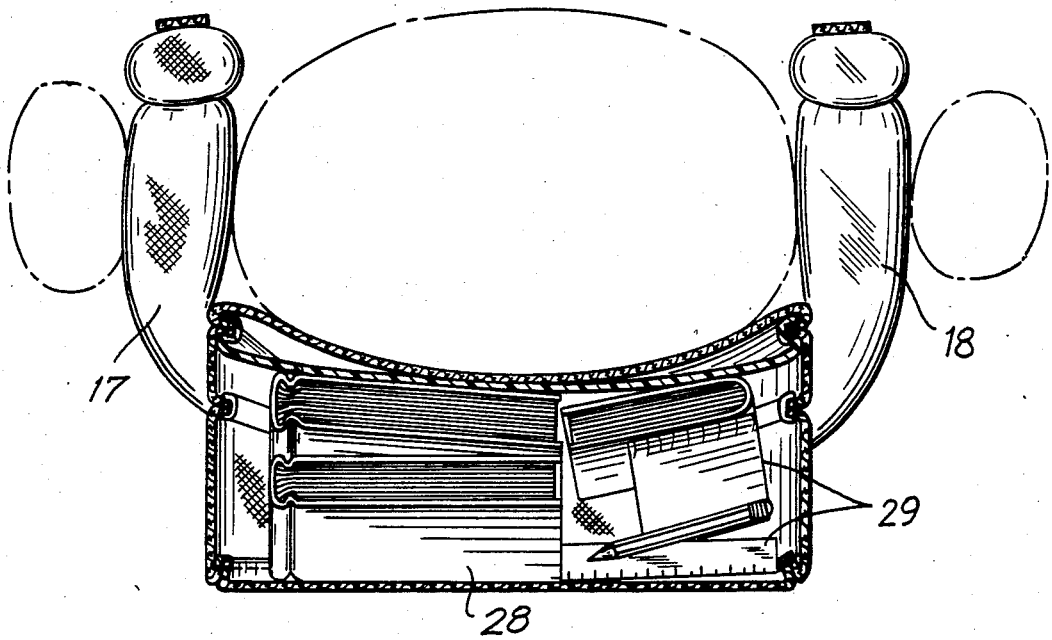
FIG. 5 is a cross-sectional view of the character back pack taken through line 5—5 of FIG. 4.

FIG. 5 is a cross-sectional view showing the interior storage space 28 provided in doll pack 41. As can be seen and as has been discussed, space 28 is significantly larger than would be possible if doll 40 were not provided with doll back pack 43.

By constructing and arranging a character pack in accordance with the invention several advantages are obtained. For example, a back pack or storage container attractive to young children is provided. As well as providing an atractive novelty item, by placing a character's back pack on the back of a stuffed character, an enlarged carrying space is provided and is available for storage. Additionally, adjustable straps allow the character pack to be worn by older children. The construction is also applicable to a wide variety of character shapes which do not necessarily have a large body portion as the character's back pack provides the increased and useful storage feature of the invention.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing(s) shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A character pack for storing items therein, comprising:

a character having a body portion with a front surface and a rear surface;

the body portion having a void therein and the rear surface formed with an opening for providing access to the void in the body portion; and a character.back pack secured to the rear surface of the body portion of the character, the character back pack formed with an opening in the back surface of substantially the same size as the opening in the body so that the interior walls of the character back pack and the void in the body are substantially continuous for cooperating with the opening in the rear surface of the character for providing a useable storage volume greater than the volume of the void in the body portion or the volume of the character back pack alone, the character back pack formed with closure means for providing selective access to the interior of the character back pack and the void of the body portion through the cooperating opening of the character back pack and the opening in the rear surface of the body portion.

2. The character pack of claim 1 wherein the character is formed with four limbs extending from the body portion with a pair of straps extending between each pair of limbs on each side of the character so that the character pack may be worn by a wearer.

3. The character pack of claim 2, wherein the straps are of adjustable length.

4. The character pack of claim 2, wherein the void within body portion of the character is defined by a water-proof material.

5. The character pack of claim 2, wherein the body portion of the character other than the interior void is stuffed with a soft packing material.

6. The character pack of claim 1, wherein the void within interior body volume of the character is defined by a water-proof material.

7. The character pack of claim 1, wherein the body portion of the character other than the void space is stuffed with a soft packing material.

8. The character pack of claim 1, further including a key ring fixed to the character shaped body portion.

9. The character pack of claim 1, wherein the character is in the shape of an animal figure.

10. The character pack of claim 1, wherein the character is in the shape of a doll figure.

* * * * *